US011801592B1

(12) United States Patent
Ducharme

(10) Patent No.: US 11,801,592 B1
(45) Date of Patent: Oct. 31, 2023

(54) RAIL HAMMER ASSEMBLIES AND METHODS

(71) Applicant: Wesley Ducharme, Shreveport, LA (US)

(72) Inventor: Wesley Ducharme, Shreveport, LA (US)

( * ) Notice: Subject to any disclaimer, the term of this patent is extended or adjusted under 35 U.S.C. 154(b) by 364 days.

(21) Appl. No.: 17/108,603

(22) Filed: Dec. 1, 2020

Related U.S. Application Data

(60) Provisional application No. 62/942,366, filed on Dec. 2, 2019.

(51) Int. Cl.
*B25D 11/00* (2006.01)
*B25D 11/06* (2006.01)

(52) U.S. Cl.
CPC ..... *B25D 11/064* (2013.01); *B25D 2250/171* (2013.01)

(58) Field of Classification Search
CPC ..... B25D 11/064; B25D 2250/145
See application file for complete search history.

(56) References Cited

U.S. PATENT DOCUMENTS 6,520,269 B2 2/2003 Geiger et al.
8,499,836 B2 8/2013 Moriarty et al.
9,941,779 B2 4/2018 Paine et al.
10,273,773 B2 4/2019 Collins
2009/0050425 A1* 2/2009 Murakami ..... F16F 9/535 188/267.2
2012/0293103 A1* 11/2012 Forster ..... H02P 27/08 318/503
2018/0141197 A1 5/2018 Pugliese et al.

* cited by examiner

*Primary Examiner* — Chelsea E Stinson
(74) *Attorney, Agent, or Firm* — R. Keith Harrison

(57) ABSTRACT

Rail hammer assemblies suitable for advancing driving a member into or toward or pulling a member from or away from a workpiece, respectively may include an impact mechanism. The impact mechanism may include an elongated slide rail. A first rail impact plate may be carried by the slide rail. A second rail impact plate may be carried by the slide rail in spaced-apart relationship to the first rail impact plate. At least a first permanent magnet may be carried by the slide rail outside the first rail impact plate. At least a second permanent magnet may be carried by the slide rail outside the second rail impact plate. An impact hammer may be slidably carried by the slide rail between the first rail impact plate and the second rail impact plate. The impact hammer may include at least one electromagnet. A control system may include at least one power source. A first button may interface with the at least one power source and the electromagnet to facilitate travel of the impact hammer in a first direction on the slide rail. A second button may interface with the at least one power source and the electromagnet to facilitate travel of the impact hammer in a second direction on the slide rail. Rail hammer methods are also disclosed.

20 Claims, 6 Drawing Sheets

RAIL HAMMER ASSEMBLIES AND METHODS

CROSS-REFERENCE TO RELATED APPLICATIONS

This application claims the benefit of U.S. provisional application No. 62/942,366, filed Dec. 2, 2019 and entitled RAIL HAMMER ASSEMBLIES AND METHODS. which provisional application is hereby incorporated by reference herein in its entirety.

FIELD

Illustrative embodiments of the disclosure are generally directed to tools and methods for driving a member into or pulling a member from a workpiece. More particularly, illustrative embodiments of the disclosure relate to rail hammer assemblies and methods which include use of an electromagnet to generate a selected forward or reverse hammer action suitable for driving a member into or pulling a member from a workpiece, respectively.

SUMMARY

Illustrative embodiments of the disclosure are generally directed to rail hammer assemblies which include an electromagnet to generate a selected forward or reverse hammer action suitable for advancing or driving an accessory into or toward or pulling a member out of or away from a workpiece, respectively. An illustrative embodiment of the rail hammer assemblies may include an impact mechanism having an elongated slide rail having a first rail end and a second rail end, the first rail end configured for attachment to the accessory. A first rail impact plate may be carried by the slide rail. A second rail impact plate may be carried by the slide rail in spaced-apart relationship to the first rail impact plate. At least a first permanent magnet may be carried by the slide rail between the first rail end and the first rail impact plate. At least a second permanent magnet may be carried by the slide rail between the second rail end and the second rail impact plate. An impact hammer may be slidably carried by the slide rail between the first rail impact plate and the second rail impact plate. At least one electromagnet may be carried by the impact hammer. A control system may include at least one power source. A first button may interface with the at least one power source and the electromagnet. A second button may interface with the at least one power source and the electromagnet. The control system may be configured to induce magnetic attraction between the at least one electromagnet and the at least a first permanent magnet in a first magnetic polarity responsive to depression of the first button, such that the impact hammer slides on the slide rail and strikes the first rail impact plate. The control system may be configured to induce magnetic attraction between the at least one electromagnet and the at least a second permanent magnet in a second magnetic polarity responsive to depression of the second button, such that the impact hammer slides on the slide rail and strikes the second rail impact plate.

Illustrative embodiments of the disclosure are further generally directed to rail hammer methods. An illustrative embodiment of the rail hammer methods may include obtaining a rail hammer assembly having an impact mechanism with an elongated slide rail, a first rail impact plate carried by the slide rail, a second rail impact plate carried by the slide rail in spaced-apart relationship to the first rail impact plate, a first permanent magnet carried by the slide rail outside the first rail impact plate, a second permanent magnet carried by the slide rail outside the second rail impact plate and an impact hammer slidably carried by the slide rail between the first rail impact plate and the second rail impact plate; selecting a tool attachment; coupling the tool attachment to the impact mechanism of the rail hammer assembly; applying the tool attachment to a workpiece; and performing at least one of the following: operating the impact mechanism in a forward mode by energizing and magnetizing the electromagnet in a first polarity to cause the impact hammer of the impact mechanism to strike the first rail impact plate on the slide rail of the impact mechanism; and operating the impact mechanism in a rearward mode by energizing and magnetizing the electromagnet in a second polarity to cause the impact hammer of the impact mechanism to strike the second rail impact plate on the slide rail of the impact mechanism.

BRIEF DESCRIPTION OF THE DRAWINGS

Illustrative embodiments of the disclosure will now be described, by way of example, with reference to the accompanying drawings, in which.

DETAILED DESCRIPTION OF THE DRAWINGS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower". "left", "rear", "right", "front". "vertical". "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 6:
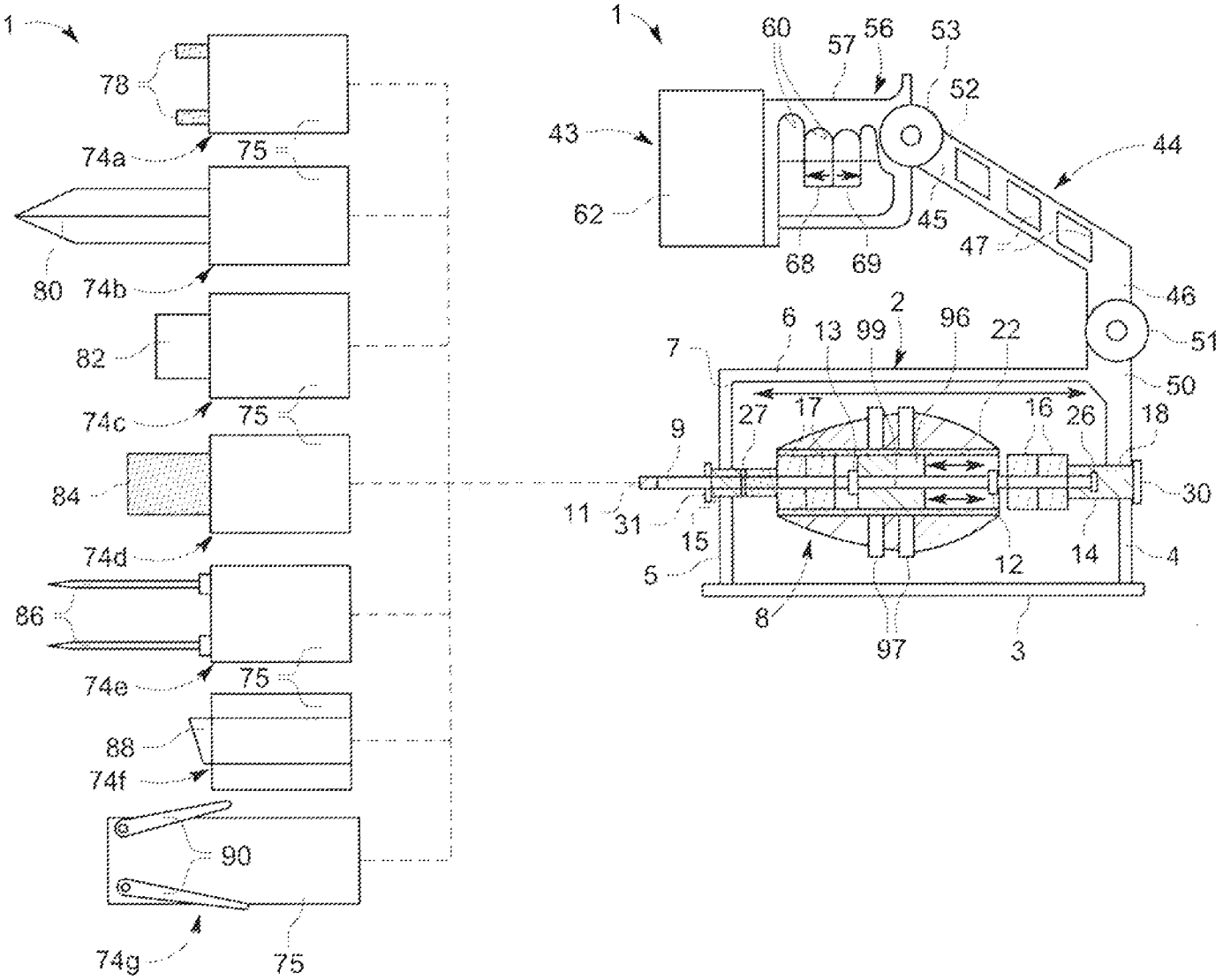
FIG. 6 is an exploded side view illustrating typical selective attachment of each of multiple accessories to the impact mechanism of the rail hammer assembly in various applications of the assembly.

Referring initially to FIG. 6 of the drawings, an illustrative embodiment of the rail hammer assemblies, hereinafter assembly, is generally indicated by reference numeral 1. The assembly 1 may include an assembly frame 2. An electromagnet-operated impact mechanism 8 may be disposed for longitudinal linear displacement in the assembly frame 2. In some embodiments, a handle assembly 43 may extend from the assembly frame 2. In typical application of the assembly 1, which will be hereinafter described, any of various types of tool attachments 74*a*-74*g* may be interchangeably attached to the impact mechanism 8. The impact mechanism 8 may generate a selected forward or reverse hammer action which imparts a pushing or pulling action, respectively, on the selected attached tool attachment 74*a*-74*g* as the tool attachment 74*a*-74*g* is typically applied to a workpiece (not illustrated). A user (not illustrated) of the assembly 1 may ergonomically grip the handle assembly 43 to optimize comfort, accuracy and performance in operation of the assembly 1. The handle assembly 43 may be positioned in a selected orientation with respect to the assembly housing 2 and impact mechanism 8 to achieve optimum reach and positioning capability of the impact mechanism 8 and comfort for the user.

Figure 1:
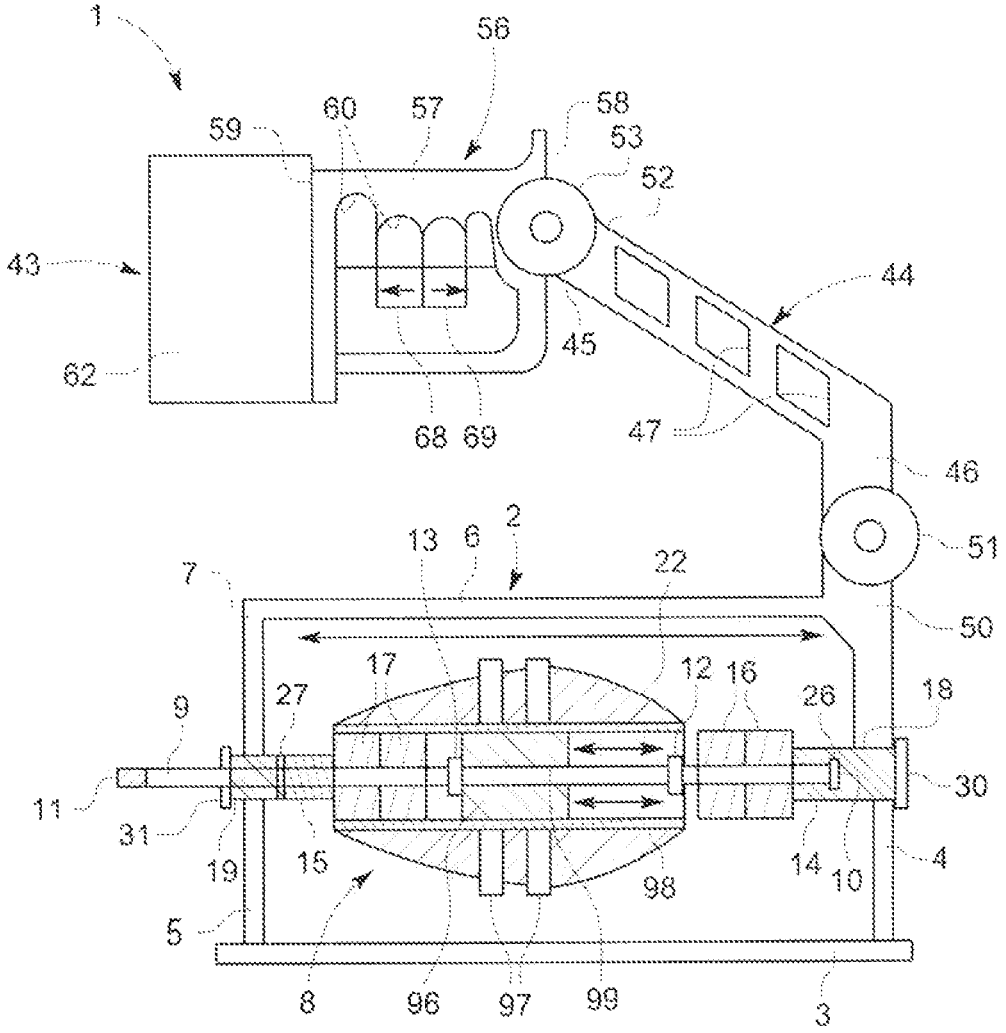
FIG. 1 is a side view of an illustrative embodiment of the rail hammer assemblies of the disclosure.
Figure 2:
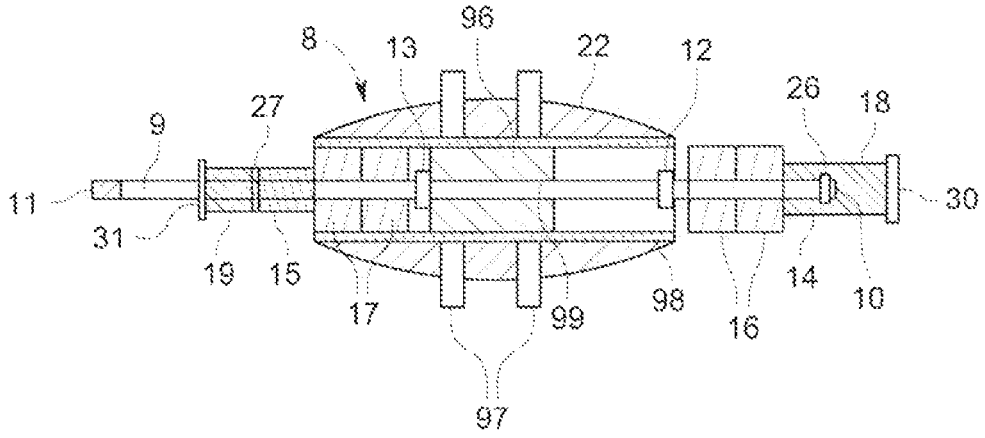
FIG. 2 is a side view of a typical impact mechanism suitable for implementation of the rail hammer assemblies of the disclosure, with a hammer engaging a front rail impact plate of the impact mechanism.
Figure 3:
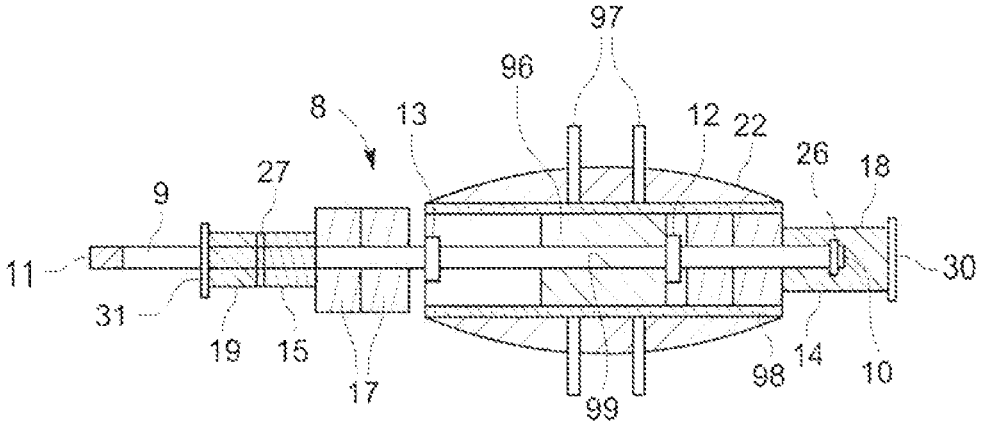
FIG. 3 is aside view of the impact mechanism, with the hammer engaging arear rail impact plate of the impact mechanism.

As illustrated in FIGS. 1-3, the impact mechanism 8 of the rail hammer assembly 1 may include an elongated slide rail 9. The slide rail 9 may have a rear rail end 10 and a front rail end 11. The front rail end 11 may be configured for attachment to an accessory 74 (FIG. 6) such as through a threaded and/or other attachment. The slide rail 9 may extend through a rear shaft housing 14 and a front shaft housing 15. The rear shaft housing 14 and the front shaft housing 15 may be supported by the assembly frame 2 in a manner which will be hereinafter described. A rear cap 30 and a front cap 31 may be provided on the rear shaft housing 14 and the front shaft housing 15, respectively.

A rear washer 26 may be welded and/or otherwise attached to the slide rail 9 at or adjacent to the rear rail end 10. A front washer 27 may in like manner be welded and/or otherwise attached to the slide rail 9. The rear washer 26 and the front washer 27 may be slidably disposed in the rear shaft housing 14 and the front shaft housing 15, respectively.

A rear magnet spring 18 may be disposed in the rear shaft housing 14 between the rear shaft cap 30 and the rear washer 26. A front magnet spring 19 may be disposed in the front shaft housing 15 between the front shaft cap 31 and the front washer 27. The purpose of the rear magnet spring 18 and the front magnet spring 19 will be hereinafter described.

A rear rail impact plate 12 and a front rail impact plate 13 may extend outwardly from the slide rail 9 in spaced-apart relationship to each other. The rear rail impact plate 12 and the front rail impact plate 13 may be welded and/or otherwise attached to the slide rail 9, or may be casted, molded or otherwise fabricated in one piece with the slide rail 9 according to the knowledge of those skilled in the art.

At least one permanent rear magnet 16 and at least one permanent front magnet 17 may be provided in spaced-apart relationship to each other on the slide rail 9. The rear magnets 16 may be disposed between the rear rail end 10 and the rear rail impact plate 12. The front magnets 17 may be disposed between the front rail end 11 and the front rail impact plate 17. The rear magnet 16 and the from magnet 17 may each have a rail bore (not numbered) which receives the slide rail 9. The same poles of the rear magnet 16 and the from magnet 17 may face each other. Accordingly, in some embodiments, the North magnetic poles of the respective rear magnet 16 and front magnet 1 may face each other. In other embodiments, the South magnetic poles of the respective rear magnet 16 and front magnet 17 may face each other.

An impact hammer 96 may be slidably disposed on the slide rail 9 between the rear rail impact plate 12 and the front rail impact plate 13. A hammer bore 99 may traverse the impact hammer 96. Accordingly, the hammer bore 99 may receive the slide rail 9 to slidably mount the impact hammer 96 on the slide rail 9. The impact hammer 96 may include brass, composite and/or other suitable metal or material.

At least one tube support 97 may extend outwardly from the impact hammer 96. An elongated hammer tube 98 may be supported by the tube supports 97. At least one electrically-conductive electromagnet 22 may be provided on the hammer tube 98. Accordingly, as it is energized, the electromagnet 22 may be magnetically attracted to the rear magnets 16 and the front magnet 17 depending on the energized magnetic polarity of the electromagnet 22. Consequently, the tube supports 97, the hammer tube 98 and the electromagnet 22 may slide with the impact hammer 96 as the impact hammer 96 alternately contacts the rear rail impact plate 12 and the front rail impact plate 13, respectively.

The electromagnet 22 may include copper and/or other electrically conductive wiring which may be wound around the hammer tube 98. Accordingly, by energizing and inducing the magnetic polarity of the electromagnet 22 to the opposite magnetic polarity of the facing end of the rear magnet 16, the impact hammer 96 may slide rearwardly on the slide rail 9 until the impact hammer 96 forcefully strikes the rear rail impact plate 12, driving the slide rail 9 rearwardly and facilitating rearward movement of the accessory 74 (FIG. 6) attached to the front rail end 11 of the slide rail 9. Conversely, by energizing and inducing the magnetic polarity of the electromagnet 22 to the opposite magnetic polarity of the fang end of the front magnet 17, the impact hammer 96 may slide forwardly on the slide rail 9 until the impact hammer 96 forcefully strikes the front rail impact plate 13, driving the slide rail 9 forwardly and facilitating forward movement of the accessory 74 on the slide rail 9. Forward and reverse operation of the impact mechanism 8 thus facilitates the desired action of the accessory 74.

As the impact hammer 96 strikes the rear rail impact plate 12, the rear magnet spring 18 may isolate and protect the rear magnets 16 from impact. In like manner, as the impact hammer 96 strikes the front rail impact plate 13, the front magnet spring 19 may isolate and protect the front magnets 17 from impact.

As illustrated in FIG. 2, as the impact hammer 96 strikes the front rail impact plate 13, the hammer tube 98 may receive and accommodate the front magnets 17. As illustrated in FIG. 3, in like manner, as the impact hammer 96 strikes the rear rail impact plate 12, the hammer tube 98 may receive and accommodate the rear magnets 16.

Figure 4:
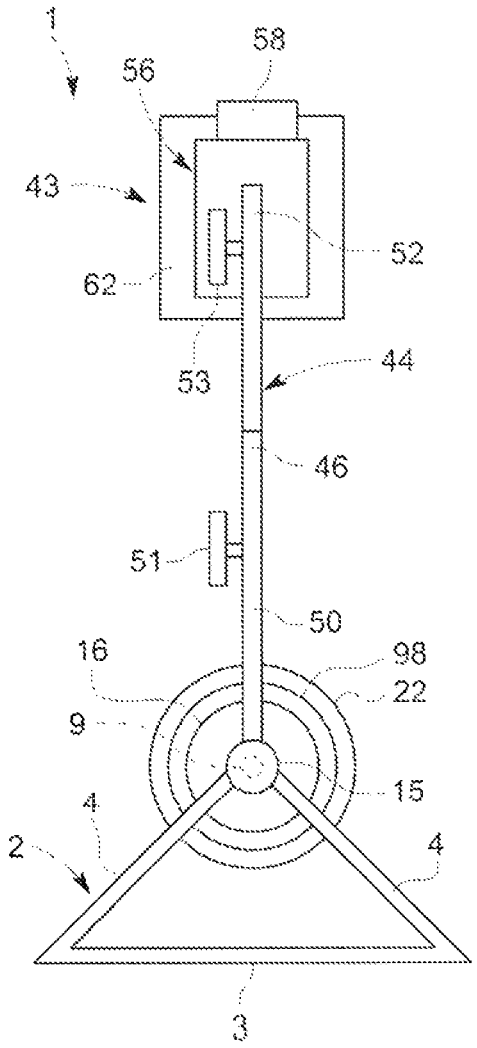
FIG. 4 is a rear view of the illustrative rail hammer assembly.

As illustrated in FIGS. 1 and 4, in some embodiments, the assembly frame 2 may have at least one bottom frame member 3. A pair of angled bottom rear frame members 4 and a pair of angled bottom front frame members 5 may extend from the bottom frame member 3. The bottom rear frame members 4 may converge on the rear shaft housing 14, and the bottom front frame members 5 may converge on the front shaft housing 15. An arm hinge 50 may extend upwardly from the rear shaft housing 14. A top front frame member 6 may extend upwardly from the front shaft housing 15. A top frame member 6 may extend between the arm hinge 50 and the top front frame member 7. Accordingly, the assembly frame 2 may render the rail hammer assembly 1 self-standing on a flat support surface (not illustrated) as the bottom frame member 3 rests on the support surface.

In some embodiments, the handle assembly 43 of the rail hammer assembly 1 may include an elongated handle arm 44. The handle arm 44 may have a rear handle arm end 45 and a front handle arm end 46 which is opposite the rear handle arm end 45. At least one arm slot 47 may extend through the handle arm 44. The front handle arm end 46 of the handle arm 44 may extend from the arm hinge 50. In some embodiments, the front handle arm end 46 may be pivotally attached or hinged to the assembly frame 2 such as via the arm hinge 50, which may have an arm hinge knob 51. Accordingly, the arm hinge knob 50 may be selectively loosened to pivot the handle arm 44 to a selected angle relative to the assembly frame 2 and tightened to lock the handle arm 44 at the selected angle.

An operating handle 56 may be attached to the rear handle arm end 45 of the handle arm 44 according to the knowledge of those skilled in the art. In some embodiments, the operating handle 56 may be pivotally attached or hinged to the rear handle arm end 45 such as via a handle hinge 52 having a handle hinge knob 53. Accordingly, the handle hinge knob 53 may be selectively loosened to pivot the operating handle 56 to a selected angle relative to the handle arm 44 and tightened to lock the operating handle 56 at the selected angle.

The operating handle 56 may include a handle grip 57 having a front handle end 58 at the rear handle arm end 45 of the handle arm 44 and a rear handle end 59 opposite the front handle end 58. Multiple, adjacent finger depressions 60 may extend into the handle grip 57. A battery compartment 62 may terminate the rear handle end 59 of the handle grip 57. The battery compartment 62 may contain at least one battery and/or other power source 67 (FIG. 3) which selectively energizes and magnetizes the electromagnet 22 typically in a manner which will be hereinafter described.

Figure 5:
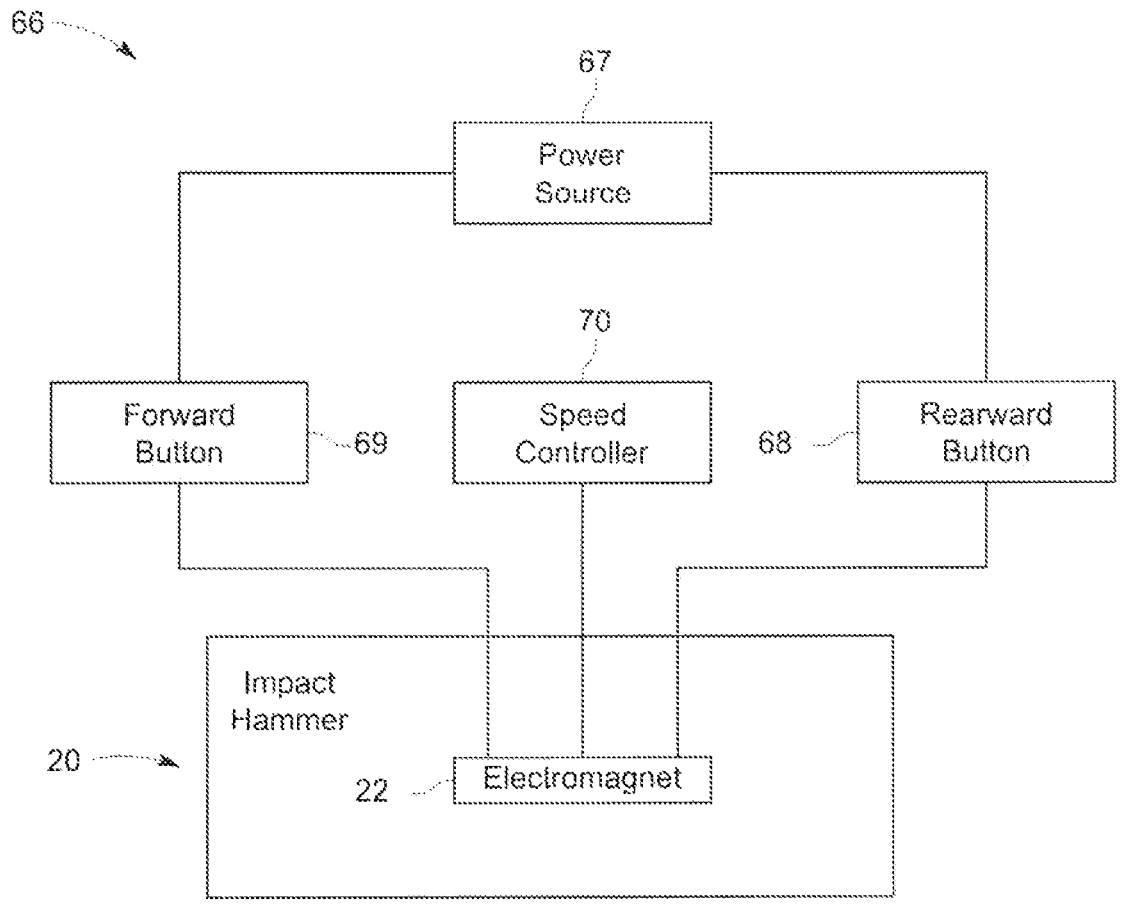
FIG. 5 is a block diagram of a typical control system suitable for implementation of the rail hammer assemblies.

A typical control system 66 which is suitable for implementation of the rail hammer assemblies 1 is illustrated in FIG. 5. The control system 66 may include at least one power source 67. In some embodiments, the power source 67 may include a rechargeable or replaceable battery, for example and without limitation. In some embodiments, the power source 67 may include an electrical outlet and power cord. In some embodiments, the power source 67 may include at least one solar cell.

A rearward button 68 and a forward button 69 may electrically interface with the power source 67 and with the electromagnet 22. Accordingly, responsive to depression of the rearward button 68, the electromagnet 22 may be energized and magnetized in the first magnetic polarity by the power source 67 to facilitate rearward travel of the impact hammer 96 on the slide rail 9. Responsive to depression of the forward button 69, the electromagnet 22 may be energized and magnetized in the second magnetic polarity by the power source 67 to facilitate forward travel of the impact hammer 96 on the slide rail 9. As illustrated in FIG. 1, the rearward button 68 and the forward button 69 may be provided on the handle grip 57 of the operating handle 56 for easy manipulation by a user (not illustrated) as the user grips the handle grip 57. As further illustrated in FIG. 5, in some embodiments, a speed controller 70 may operably interface with the electromagnet 22 to control the magnetization of the electromagnet 22, and hence, the speed of the impact hammer 96 on the slide rail 9 of the impact mechanism 8.

Referring again to FIG. 6 of the drawings, in typical application of the rail hammer assembly 1, a selected tool attachment **74*a*-74*g* may be attached to the front rail end 11 of the slide rail 9 and the impact mechanism 8 operated to selectively generate and apply a forward hammer action or a reverse hammer action on the tool attachment 74*a*-74*g* as the tool attachment 74*a*-74*g* is applied to a workpiece (not illustrated). For example and without limitation, in some applications, a moisture probe 74*e* may be attached to the front rail end 11 of the slide rail 9 and a moisture meter (not illustrated) connected to the moisture probe 74*e* to test the level of moisture in a wall space (not illustrated) in a wall of a building or other structure. Each tool attachment 74*a*-74*g* may include an accessory body 75. The accessory body 75 may be configured for threaded and/or other attachment to the front rail end 11 of the slide rail 9. Alternative mounting techniques known by those skilled in the art may be used to attach each tool attachment 74*a*-74*g* to the front rail end 11 of the slide rail 9**. Such mounting techniques may include but are not limited to screws, bolts, friction- or interference-fitting, clips, clamps, brackets and/or other mechanical fasteners suitable for the purpose.

A pair of spaced-apart probe needles 86 may extend from the accessory body 75 of the moisture probe **74*e*. A moisture meter (not illustrated) may be connected to the probe needles 86** typically in the conventional manner.

A user (not illustrated) of the assembly 1 may grasp the handle grip 57 of the operating handle 56 and initially place the probe needles 86 of the moisture probe **74*e* against the wall. Preparatory to use, the position of the operating handle 56 with respect to the assembly housing 2 and impact mechanism 8 may be adjusted as deemed necessary typically by loosening the arm hinge knob 51 of the arm hinge 50, pivoting the handle arm 44 relative to the assembly housing 2 and again tightening the arm hinge knob 51. The position of the operating handle 56 with respect to the handle arm 44 may be adjusted in like manner, typically by loosening the handle hinge knob 53 of the handle hinge 52, pivoting the operating handle 56 with respect to the handle arm 44 and again tightening the handle hinge knob 53. In this manner, the user may optimally position the moisture probe 74*e*** for maximum effectiveness and for the optimum ergonomic comfort of the user.

The impact mechanism 8 of the assembly 1 may be operated by manipulation of the rearward button 68 and/or the forward button 69 of the control system 66 (FIG. 3). Accordingly, the electromagnet 22 may initially be energized in the first magnetic polarity typically by squeezing of the rearward button 68 on the operating handle 56. This action may cause the magnetized electromagnet 22 to be magnetically attracted by the facing pole on the rear magnet 16 with its opposite magnetic polarity such that the impact hammer 96 slides rearwardly on the slide rail 9 until the impact hammer 96 typically engages or is disposed adjacent to the rear rail impact plate 12 of the slide rail 9, as illustrated in FIG. 3. Subsequent release of the rearward button 68 and squeezing of the forward button 69 may facilitate flow of electrical current from the power source 67 (FIG. 3) to the electromagnet 22. This action may energize and magnetize the electromagnet 22 in the second magnetic polarity, causing the magnetized electromagnet 22 to be magnetically attracted by the facing pole on the front magnet 17 with its opposite magnetic polarity such that the impact hammer 96 slides forwardly on the slide rail 9 until the impact hammer 96 forcefully strikes the front rail impact plate 13 of the slide rail 9, as illustrated in FIG. 2. As the impact hammer 96 strikes the front rail impact plate 13, the front rail impact plate 13 may drive the slide rail 9 forwardly. The front rail end 11 of the slide rail 9 therefore pushes the accessory body 75 of the moisture probe 74*e* forwardly and the probe needles 86 begin to penetrate the wall. The slide rail 9 may return to the pre-strike position in the assembly frame 2.

By subsequent release of the forward button 69 and depression of the rearward button 68, the electromagnet 22 may then be energized and magnetized such that the magnetized electromagnet 22 is again magnetically attracted by the facing pole of the rear magnet 16 with its opposite polarity. The impact hammer 96 may thus disengage the front rail impact plate 13 and travel rearwardly on the slide rail 9 typically until the impact hammer 96 engages or is disposed adjacent to the rear rail impact plate 12 on the slide rail 9. The rearward button 68 may then be released and the forward button 69 again depressed to reverse the polarity of the electromagnet 22. The impact hammer 96 thus again travels forwardly on the slide rail 9 until the impact hammer 96 strikes the front rail impact plate 13, again forwardly advancing the slide rail 9 and facilitating further penetration of the probe needles 86 into the wall. This forward mode operation of the impact mechanism 8 may be repeated as many times as necessary to facilitate compete penetration of the moisture probes 86 through the wall into the wall space.

After the probe needles 86 of the moisture probe 74*e* have penetrated through the wall into the wall space, the moisture meter (not illustrated) which is connected to the probe needles 86 may be operated to test the moisture content of the wall space, typically in the conventional manner. Upon conclusion of the moisture testing procedure, the probe needles 86 may be removed from the wall by operation of the impact mechanism 8 in the reverse mode. Accordingly, the electromagnet 22 may initially be energized and magnetized, typically by manipulation of the forward button 69, to position the impact hammer 96 in the forwardmost position in the housing interior 6 against or adjacent to the front rail impact plate 13. The forward button 69 may then be released and the rearward button 68 depressed to reverse the polarity of the electromagnet 22 such that the impact hammer 96 slides rearwardly on the slide rail 9 until the impact hammer 96 forcefully strikes the rear rail impact plate 12. This action reverses the motion of the slide rail 9 such that the front rail end 11 pulls the probe needles 86 from the wall. As the impact hammer 96 strikes the rear rail impact plate 12, the rear magnet spring 18 may be compressed between the rear washer 26 and the rear shaft cap 30. The foregoing reverse mode operation of the impact mechanism 8 may be repeated as many times as necessary to completely pull the probe needles 86 from the wall.

As further illustrated in FIG. 6, it will be appreciated by those skilled in the art that a wide variety of tool attachments 74 can be attached to the front rail end 11 of the slide rail 9 depending on the pushing or pulling force which is to be applied to a workpiece by operation of the assembly 1. For example and without limitation, in some applications, a custom tool attachment 74*a* having a pair of spaced-apart threaded shanks 78 may be attached to the impact mechanism 8. In other applications, a chisel 74*b* having a chisel blade 80 may be attached to the impact mechanism 8. In still other applications, a shop hammer 74*c* having a shop hammer head 82 may be attached to the impact mechanism 8. Other applications may include use of a custom tool attachment 74*d* having a single threaded shank 84; a T-post driver 74*f* having a driver head 88; and a bearing puller 74*g* having bearing puller arms 90. It will be appreciated by those skilled in the art that the various tool attachments 74*a*-74*g* are non-limiting and that other accessories may be used depending on the desired application.

Figure 7:
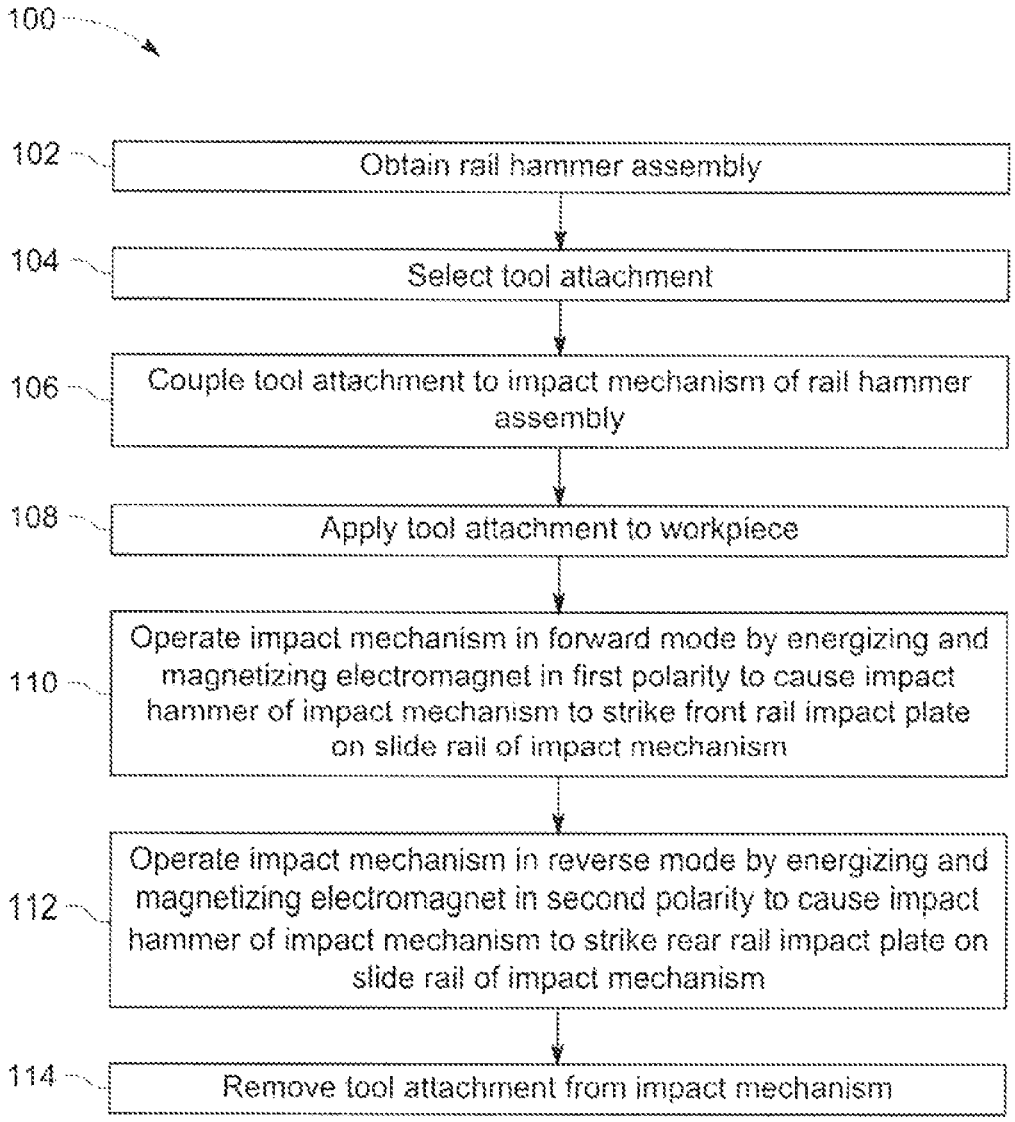
FIG. 7 is a flow diagram of an illustrative embodiment of the rail hammer methods of the disclosure.

Referring next to FIG. 7 of the drawings, a flow diagram of an illustrative embodiment of the rail hammer methods of the disclosure is generally indicated by reference numeral 100. At Step 102, a rail hammer assembly may be provided. The rail hammer assembly may include an impact mechanism. The impact mechanism may include an elongated slide rail. A first rail impact plate may be carried by the slide rail. A second rail impact plate may be carried by the slide rail in spaced-apart relationship to the first rail impact plate. A first permanent magnet may be carried by the slide rail outside the first rail impact plate. A second permanent magnet may be carried by the slide rail outside the second rail impact plate. An impact hammer may be slidably carried by the slide rail between the first rail impact plate and the second rail impact plate. The impact hammer may include an electromagnet. A control system may include at least one power source. A first button may interface with the at least one power source and the electromagnet. A second button may interface with the at least one power source and the electromagnet.

At Step 104, a tool attachment may be selected.

At Step 106, the tool attachment may be coupled to the slide rail of the impact mechanism in the hammer assembly.

At Step 108, the tool attachment may be applied to a workpiece.

At Step 110, the impact mechanism may be operated in a forward mode by energizing and magnetizing the electromagnet in a first magnetic polarity to cause the impact hammer of the impact mechanism to strike the front rail impact plate on the slide rail of the impact mechanism.

At Step 112, the impact mechanism may additionally or alternatively be operated in a reverse mode by energizing and magnetizing the electromagnet in a second magnetic polarity to cause the impact hammer of the impact mechanism to strike the rear rail impact plate on the slide rail of the impact mechanism.

At Step 114, the tool attachment may be removed from the impact mechanism.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A rail hammer assembly for directionally advancing an accessory, comprising:

an impact mechanism including:

an elongated slide rail having a first rail end and a second rail end, the first rail end configured for attachment to the accessory;

a first rail impact plate carried by the slide rail in fixed relationship to the slide rail;

a second rail impact plate carried by the slide rail in spaced-apart relationship to the first rail impact plate and in fixed relationship to the slide rail;

at least a first permanent magnet carried by the slide rail between the first rail end and the first rail impact plate;

at least a second permanent magnet carried by the slide rail between the second rail end and the second rail impact plate;

an impact hammer slidably carried by the slide rail between the first rail impact plate and the second rail impact plate, the impact hammer configured to slide with respect to the slide rail between the first rail impact plate and the second rail impact plate; and at least one electromagnet carried by the impact hammer; and a control system including:

at least one power source;

a first button interfacing with the at least one power source and the electromagnet; and a second button interlacing with the at least one power source and the electromagnet;

wherein the control system is configured to induce magnetic attraction between the at least one electromagnet and the at least a first permanent magnet in a first magnetic polarity responsive to depression of the first button, whereby the impact hammer slides on the slide rail and strikes the first rail impact plate and the first rail impact plate drives the slide rail in a first direction; and wherein the control system is configured to induce magnetic attraction between the at least one electromagnet and the at least a second permanent magnet in a second magnetic polarity responsive to depression of the second button, whereby the impact hammer slides on the slide rail and strikes the second rail impact plate and the second rail impact plate drives the slide rail in a second direction.

2. The rail hammer assembly of claim 1 further comprising an assembly frame, and wherein the impact mechanism is carried by the assembly frame.

3. The rail hammer assembly of claim 2 wherein the assembly frame comprises a bottom frame member, a pair of angled bottom rear frame members and a pair of angled bottom front frame members carried by the bottom frame members, and the impact mechanism is carried by the pair of angled bottom rear frame members and the pair of angled bottom front frame members.

4. The rail hammer assembly of claim 2 further comprising a handle assembly carried by the assembly frame.

5. The rail hammer assembly of claim 4 wherein the handle assembly comprises a handle arm carried by the assembly frame and an operating handle carried by the handle arm, and wherein the first button and the second button of the control system are carried by the operating handle.

6. The rail hammer assembly of claim 5 wherein the handle arm is adjustable with respect to the assembly frame.

7. The rail hammer assembly of claim 5 wherein the operating handle is adjustable with respect to the handle arm.

8. A rail hammer assembly for directionally advancing an accessory, comprising:

an impact mechanism including:

an elongated slide rail having a first rail end and a second rail end, the first aril end configured for attachment to the accessory;

a first rail impact plate carried by the slide rail in fixed relationship to the slide rail;

a second rail impact plate carried by the slide rail in spaced-apart relationship to the first rail impact plate and in fixed relationship to the slide rail;

at least a first permanent magnet carried by the slide rail between the first rail end and the first rail impact plate;

at least a second permanent magnet carried by the slide tail between the second rail end and the second rail impact plate;

an impact hammer slidably carried by the slide rail between the first rail impact plate and the second rail impact plate, the impact hammer configured to slide with respect to the slide rail between the first rail impact plate and the second rail impact plate;

at least one tube support carried by the impact hammer;

at least one hammer tube carried by the at least one tube support; and at least one electromagnet carried by the at least one hammer tube;

the at least one hammer tube and the at least one electromagnet configured to slide with the impact hammer as the impact hammer alternately contacts the first rail impact plate and the second rail impact plate, respectively;

a control system including:

at least one power source;

a first button interfacing with the at least one power source and the electromagnet; and a second button interfacing with the at least one power source and the electromagnet;

wherein the control system is configured to induce magnetic attraction between the at least one electromagnet and the at least a first permanent magnet in a first magnetic polarity responsive to depression of the first button, whereby the impact hammer slides on the slide rail and strikes the first rail impact plate and the first rail impact plate drives the slide rail in a first direction; and wherein the control system is configured to induce magnetic attraction between the at least one electromagnet and the at least a second permanent magnet in a second magnetic polarity responsive to depression of the second button, whereby the impact hammer slides on the slide rail and strikes the second rail impact plate and the second rail impact plate drives the slide rail in a second direction.

9. The rail hammer assembly of claim 8 further comprising art assembly frame, and wherein the impact mechanism is carried by the assembly frame.

10. The rail hammer assembly of claim 9 wherein the assembly frame comprises a bottom frame member, a pair of angled bottom rear frame members and a pair of angled bottom front frame members carried by the bottom frame members, and the impact mechanism is carried by the pair of angled bottom rear frame members and the pair of angled bottom front frame members.

11. The rail hammer assembly of claim 9 further comprising a handle assembly carried by the assembly frame.

12. The rail hammer assembly of claim 11 wherein the handle assembly comprises a handle arm carried by the assembly frame and an operating handle carried by the handle arm, and wherein the first button and the second button of the control system are carried by the operating handle.

13. The rail hammer assembly of claim 12 wherein the handle arm is adjustable with respect to the assembly frame.

14. The rail hammer assembly of claim 12 wherein the operating handle is adjustable with respect to the handle arm.

15. A hammer method, comprising:

obtaining a rail hammer assembly including:

an impact mechanism having:

an elongated slide rail with a first rail end and a second rail end;

a first rail impact plate carried by the slide rail in fixed relationship to the slide rail;

a second rail impact plate carried by the slide rail in spaced-apart relationship to the first rail impact plate and in fixed relationship to the slide rail;

at least a first permanent magnet carried by the slide rail between the first rail end and the first rail impact plate;

at least a second permanent magnet carried by the slide rail between the second rail end and the second rail impact plate; and an impact hammer slidably carried by the slide rail between the first rail impact plate and the second rail impact plate, the impact hammer configured to slide with respect to the slide rail between the first rail impact plate and the second rail impact plate;

selecting a tool attachment;

coupling the tool attachment to the impact mechanism of the rail hammer assembly;

applying the tool attachment to a workpiece; and performing at least one of the following:

operating the impact mechanism in a forward mode by energizing and magnetizing the electromagnet in a first magnetic polarity to cause the impact hammer of the impact mechanism to strike the first rail impact plate on the slide rail of the impact mechanism, whereby the first rail impact plate drives the slide rail in a first direction; and operating the impact mechanism in a rearward mode by energizing and magnetizing the electromagnet in a second magnetic polarity to cause the impact hammer of the impact mechanism to strike the second rail impact plate on the slide rail of the impact mechanism, whereby the second rail impact plate drives the slide rail in a second direction.

16. The method of claim 15 wherein selecting the tool attachment comprises selecting a custom tool attachment having a pair of spaced-apart threaded shanks, a chisel having a chisel blade, a shop hammer having a shop hammer head, a custom tool attachment having a single threaded shank, a T-post driver having a driver head or a bearing puller having hearing puller arms.

17. The method of claim 15 wherein obtaining the rail hammer assembly comprises obtaining the rail hammer assembly comprising an assembly frame, and wherein the impact mechanism is carried by the assembly frame.

18. The method of claim 17 wherein obtaining the rail hammer assembly comprising the assembly frame comprises obtaining the rail hammer assembly comprising the assembly frame comprising a bottom frame member, a pair of angled bottom rear frame members and a pair of angled bottom front frame members carried by the bottom frame members, and the impact mechanism is carried by the pair of angled bottom rear frame members and the pair of angled bottom front frame members.

19. The method of claim 1 wherein obtaining the rail hammer assembly comprising the assembly frame further comprises obtaining the rail hammer assembly comprising the assembly frame having a handle assembly carried by the assembly frame.

20. The method or claim 19 wherein obtaining the rail hammer assembly comprising the assembly frame having the handle assembly carried by the assembly frame comprises obtaining the assembly frame having the handle assembly including a handle arm carried by the assembly frame and an operating handle carried by the handle arm, and wherein the first button and the second button of the control system are carried by the operating handle.

* * * * *